US010286276B2

(12) United States Patent
O'Neill

(10) Patent No.: US 10,286,276 B2
(45) Date of Patent: May 14, 2019

(54) LIGHTED GAMING PLATFORM

(71) Applicant: Dean O'Neill, Brighton, MI (US)

(72) Inventor: Dean O'Neill, Brighton, MI (US)

( * ) Notice: Subject to any disclaimer, the term of this patent is extended or adjusted under 35 U.S.C. 154(b) by 0 days.

(21) Appl. No.: 15/656,413

(22) Filed: Jul. 21, 2017

(65) Prior Publication Data

US 2018/0085649 A1 Mar. 29, 2018

Related U.S. Application Data

(60) Provisional application No. 62/400,823, filed on Sep. 28, 2016.

(51) Int. Cl.
*A63B 63/00* (2006.01)
*A63B 67/06* (2006.01)
(Continued)

(52) U.S. Cl.
CPC ..... *A63B 67/06* (2013.01); *A63B 65/00* (2013.01); *F21L 4/08* (2013.01); *F21V 3/0625* (2018.02);
(Continued)

(58) Field of Classification Search
CPC ..... A63B 67/06; A63B 65/00; A63B 2207/02; A63B 2067/061; A63B 2071/0694; A63B 2209/00; F21V 3/0445; F21V 23/02; F21V 3/0625; F21L 4/08; F21Y 2115/10; F21Y 2103/20
(Continued)

(56) References Cited

U.S. PATENT DOCUMENTS 4,709,929 A * 12/1987 Mills ..... A63B 63/08 273/402
4,961,586 A * 10/1990 Conville ..... A63B 67/06 273/402
(Continued)

OTHER PUBLICATIONS

Kruisselbrink, T. et al., "Photometric measurements of lighting quality: An overview", Building and Environment, 2018, pp. 42-52, vol. 138, © 2018 The Authors. Published by Elsevier Ltd.; DOI: 10.1016/j.buildenv.2018.04.028.
(Continued)

*Primary Examiner* — Vishu K Mendiratta
(74) *Attorney, Agent, or Firm* — Avery N. Goldstein; Blue Filament Law PLLC

(57) ABSTRACT

A cornhole platform is provided that offers improved distributed lighting across the platform playing surfaces for nighttime play, as well as enhanced aesthetics and graphic presentation. The platform playing surfaces are formed from acrylic or acrylic glass. A translucent finish is obtained on the playing surface by sanding the underside layer of the acrylic sheet, where the diffused finish is used to trap light provided by light sources that are arranged along the perimeter of a frame that holds the one or more acrylic sheets. The sanded finish acts to diffuse light from the light source to more evenly fill the playing surface with light. As a result, the "spotlight effect" common to conventional illuminated gameboards is precluded thereby making play under low ambient light conditions of twilight or outdoor darkness possible without creating night vision impairment associated with looking into a comparatively bright light relative to the ambient lighting.

18 Claims, 4 Drawing Sheets

(51) Int. Cl.

| | |
|---|---|
| ***F21V 23/02*** | (2006.01) |
| ***F21L 4/08*** | (2006.01) |
| ***A63B 65/00*** | (2006.01) |
| ***F21V 3/06*** | (2018.01) |
| *F21Y 115/10* | (2016.01) |
| *F21Y 103/20* | (2016.01) |
| *A63B 71/06* | (2006.01) |

(52) U.S. Cl.
CPC ..... *F21V 23/02* (2013.01); *A63B 2067/061* (2013.01); *A63B 2071/0694* (2013.01); *A63B 2207/02* (2013.01); *A63B 2209/00* (2013.01); *F21Y 2103/20* (2016.08); *F21Y 2115/10* (2016.08)

(58) Field of Classification Search
USPC ..... 273/402, 398; 473/570
See application file for complete search history.

(56) References Cited

U.S. PATENT DOCUMENTS 7,934,857 B2 * 5/2011 Kukita ..... G07F 17/3211 362/231
8,162,318 B1 * 4/2012 Peterson ..... A63B 67/06 273/343
8,807,569 B1 * 8/2014 Davis ..... A63B 67/06 273/371
8,872,379 B2 * 10/2014 Ruiz ..... B60L 11/1816 307/66
2004/0209667 A1 * 10/2004 Emori ..... G07F 17/3211 463/20
2006/0125186 A1 * 6/2006 Digges, III ..... A63B 67/06 273/402
2009/0273481 A1 * 11/2009 Traywick ..... H01M 10/465 340/636.1
2010/0317470 A1 * 12/2010 Cea ..... A63B 43/06 473/570
2012/0038108 A1 * 2/2012 McLaughlin, Jr. .... A63B 63/08 273/402
2015/0335971 A1 * 11/2015 Fissell ..... A63B 67/06 273/407
2017/0014704 A1 * 1/2017 Bell ..... A63F 9/0278

OTHER PUBLICATIONS

Giamundo, S., "Quantifying Light: Intensity, Uniformity Hold the Key", Test & Measurement, Photonics Handbook, Photonics Media, 11 pages, Retrieved from the Internet on Aug. 8, 2018; https://www.photonics.com/Article.aspx?AID=25117.

* cited by examiner

LIGHTED GAMING PLATFORM

CROSS-REFERENCE TO RELATED APPLICATION

This application claims priority of U.S. Provisional Patent Application Ser. No. 62/400,823 filed Sep. 28, 2016, which is incorporated herein by reference.

FIELD OF THE INVENTION

The present invention in general relates to games and in particular to a lighted translucent cornhole raised platform.

BACKGROUND OF THE INVENTION

Cornhole or bean bag toss is a game that is generally played outdoors in which players take turns throwing bags of corn or bean bags at a raised platform with a hole in the upper or far end. A bag thrown in the hole scores 3 points, while a bag that lands and stays on the platform scores 1 point. Play continues until a team or player reaches the score of 21.

Cornhole matches are played with two sets of four bags each that are thrown or tossed at opposing platforms by competing teams made up of one or two players. Each set of bags are identifiable from the other set by different colors, artwork, or patterns. Cornhole matches are broken down into innings or frames of play. During each frame, every player throws four bags. A player may toss the bag from either the left or right of a pitcher's box, which is the rectangular area directly to the left or right of a platform. The bottom of the platform forms the foul line. Players may not step over the foul line while pitching. The American Cornhole Organization Official Cornhole Rules call for double-seamed fabric bags measuring 6 by 6 inches (150 by 150 mm) and weighing 15 to 16 ounces (430 to 450 g). The final weight of the bag may vary due to the material of the bag itself.

FIG. 1 illustrates a typical cornhole platform 10 that has a top surface 12 that measurers 2 by 4 feet (0.61 by 1.22 m), with a target hole 20 that has a diameter of 6-inches (150 mm) and is centered 9 inches (230 mm) from the top edge 14. The platform 10 is set at an angle with the top edge 14 of the playing surface 12 at twelve inches (300 mm) above the ground, and the bottom edge 16 at about 3-4 inches (76-102 mm) above the ground. Support legs 22 that are attached to sides 18 at the top edge 14 are used to elevate the platform 10 at the desired or required angle. A regulation court has the target holes 20 set 33 feet (10 m) apart, or 27 feet (8.2 m) between the bottoms 16 of the platforms 10. Shorter distances can be used when younger players are participating or there is not sufficient room.

While existing cornhole platforms are well established, there exists a need for platforms that offer improved lighted surfaces for nighttime play as well as enhanced aesthetics and graphic presentation.

SUMMARY OF THE INVENTION

A gaming platform is provided that includes a frame with at least one support leg pivotally attached, one or more translucent panels each having a diffused finish supported by the frame, the one or more translucent panels forming a gaming surface with a target hole in one of the translucent panels, the diffused finish of the translucent panels acting to evenly fill the playing surface with light from a light source mounted to the frame.

A process of game play includes extending at least one support leg pivotally attached to a frame of a pair of gaming platforms to set the playing surface at an angle, spacing the target holes in the pair of gaming platforms 33 feet apart, and illuminating a light source under low ambient light conditions, the light from the light source filling the translucent surface of the playing surface. Game play includes tossing a set of cornhole or bean bags assigned to a player or a team at a target hole in the translucent panels of an opponent's gaming platform, where one of the set of cornhole or bean bags tossed in the target hole scores 3 points, while a cornhole or bean bag that lands and stays on the platform scores 1 point; and where play continues until the team or player reaches the score of 21.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

The present invention has utility as a cornhole platform that offers improved distributed lighting across the platform playing surfaces for nighttime play, as well as enhanced aesthetics and graphic presentation. In a specific inventive embodiment, the platform playing surfaces are formed from poly(methyl methacrylate) known as acrylic or acrylic glass, which is a transparent thermoplastic often used in sheet form as a lightweight or shatter-resistant alternative to glass. The acrylic glass used in embodiments of the invention is available under trade names illustratively including PLEXIGLAS™, ACRYLITE™, LEXAN™, LUCITE™, and PERSPEX™. A diffused or cloudy (synonymously referred to herein as translucent) finish is obtained on the playing surface by sanding the underside layer of the acrylic sheet, where the diffused finish is used to trap light provided by light sources that are arranged along the perimeter of a frame that holds the one or more acrylic sheets. The sanded finish acts to diffuse light from the light source to more evenly fill the playing surface with the light from the light sources. As a result, the "spotlight effect" common to conventional illuminated gameboards is precluded thereby making play under low ambient light conditions of twilight or outdoor darkness possible without creating night vision impairment associated with looking into a comparatively bright light relative to the ambient lighting.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Figure 1:
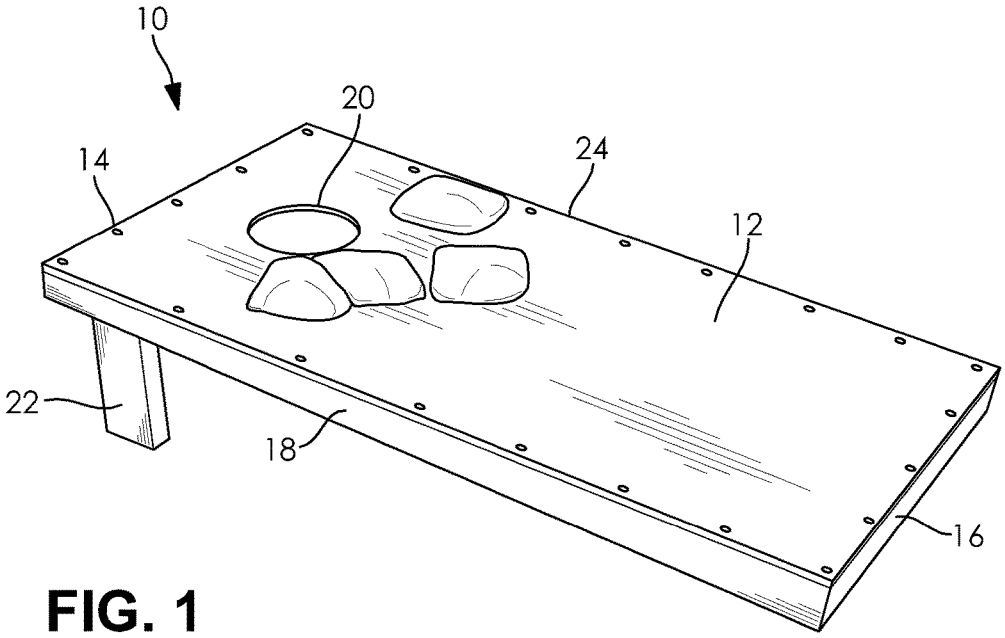
FIG. 1 is a photograph of a prior art cornhole platform.
Figure 2:
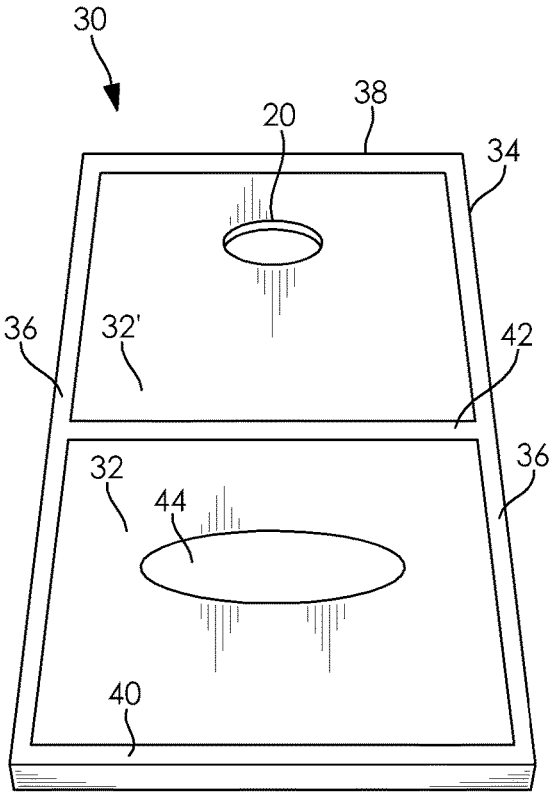
FIG. 2 is a top perspective photographic view of a translucent paneled cornhole platform with applied artwork in accordance with an embodiment of the invention.

Referring now to the figures, FIG. 2 is a top perspective view of a translucent paneled cornhole platform 30 with an optional applied artwork 44 applied to the one of the translucent playing surface panels 32, and a target hole 20 is provided in the upper surface panel 32'. The applied artwork 44 may illustratively include logos for sport teams, schools, or companies, as well as product advertising, or may be customized by the user. The playing surfaces (32, 32') are held in place by a frame 34. The frame 34 may illustratively be made of wood, metal, or composite materials. The frame 30 may have an upper cross member 38 and a lower cross member 40 that join to the side members 36. A center member 42 is present if the translucent playing surface is split into two separate panels (32, 32').

Figure 3:
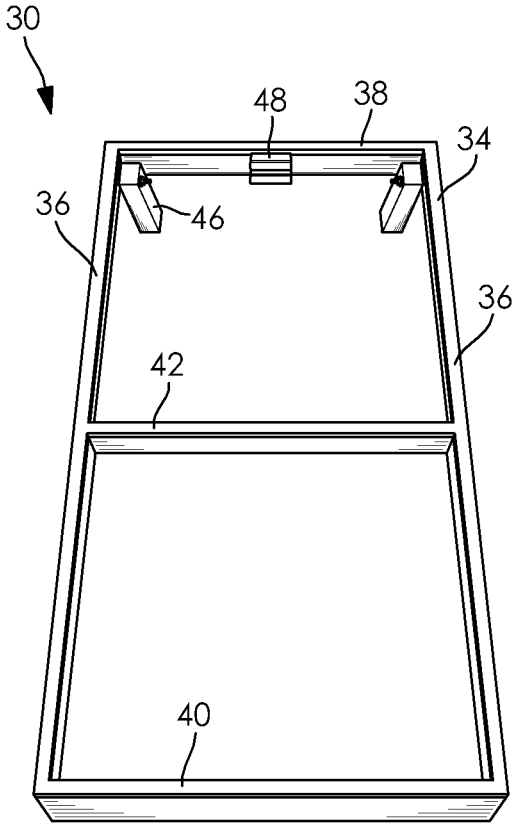
FIG. 3 is a top perspective photographic view of the cornhole platform of FIG. 2 with the translucent panels removed to reveal the frame and support legs in accordance with an embodiment of the invention.
Figure 4:
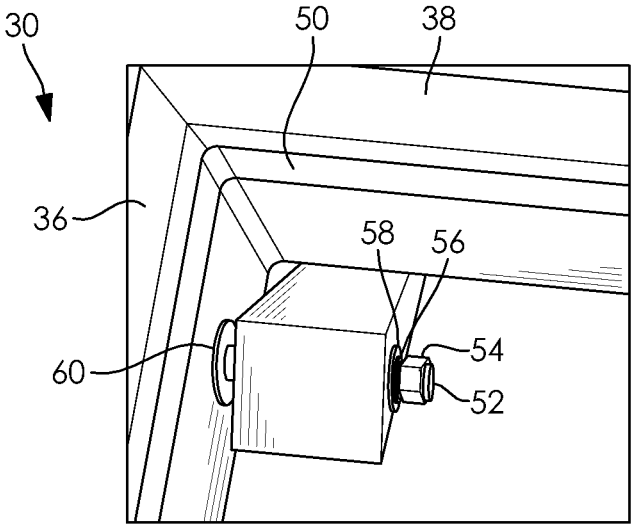
FIG. 4 is a close up photograph showing the left upper portion of the frame with the securements holding the left pivoting support leg and perimeter lighting strip visible in accordance with an embodiment of the invention.

FIG. 3 is a top perspective photographic view of the cornhole platform 30 shown in FIG. 2 with the translucent panels (32, 32') removed to reveal the frame 34 and a pair of support legs 46. The support legs 46 may be pivotally attached to the side members 36, and the support legs 46 may be adjusted to provide a desired angle to the cornhole platform 30. FIG. 4 is a close up photograph showing the left upper portion of the frame 34 with a set of securements holding the left pivoting support leg 46.

In a specific embodiment, the frame 34 may be made of 1"(inch)×3"(inch) select pine and is routed along the inside for a set of inlayed lighting sources 50. The lights may be 4.5 watt (w) light emitting diodes that may be battery powered by 3-AA batteries. Each of the support legs 46 may be 2"(inch)×2"(inch) select pine with 5/15"×3" shoulder bolts (52) holding the legs 46 that are inlayed into the wood with a 5/16" washer (60) between the side frame member 36 and the leg 46 with a 1¼" washer (58) then 1 5/16" split lock washer (56) followed by a 5/16 lock nut (54) screwed on to the thread of the shoulder bolts (52).

Figure 5:
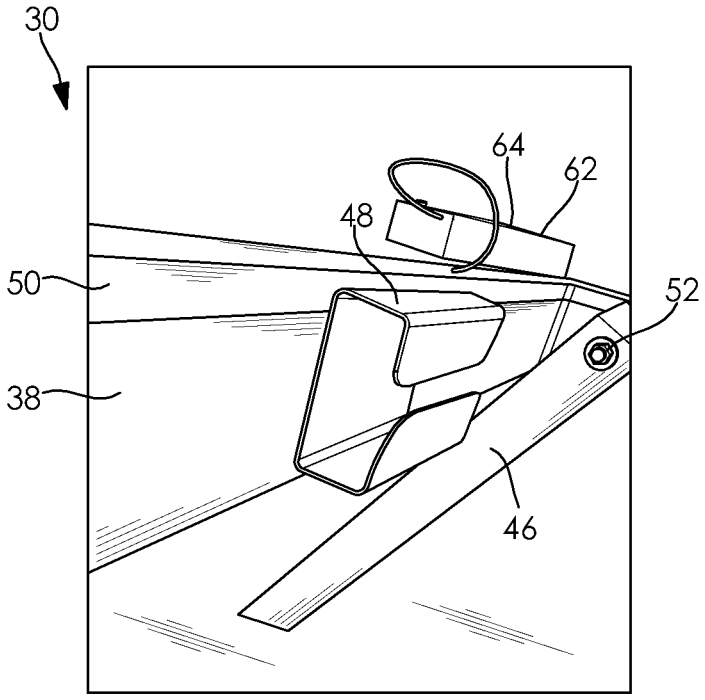
FIG. 5 is a close up photograph showing a battery mounting bracket affixed to upper portion of the frame and a battery pack in the foreground with the right pivoting support leg and perimeter lighting strip also visible in accordance with an embodiment of the invention.
Figure 6:
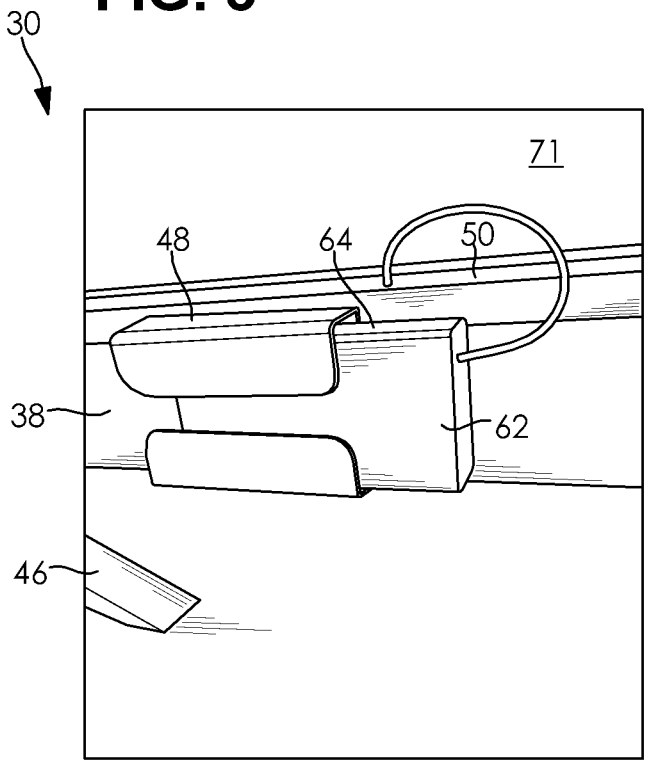
FIG. 6 is a close up photograph of the battery pack mounted in the battery bracket, and the battery pack wired to the lighting strip in accordance with an embodiment of the invention.
Figure 7:
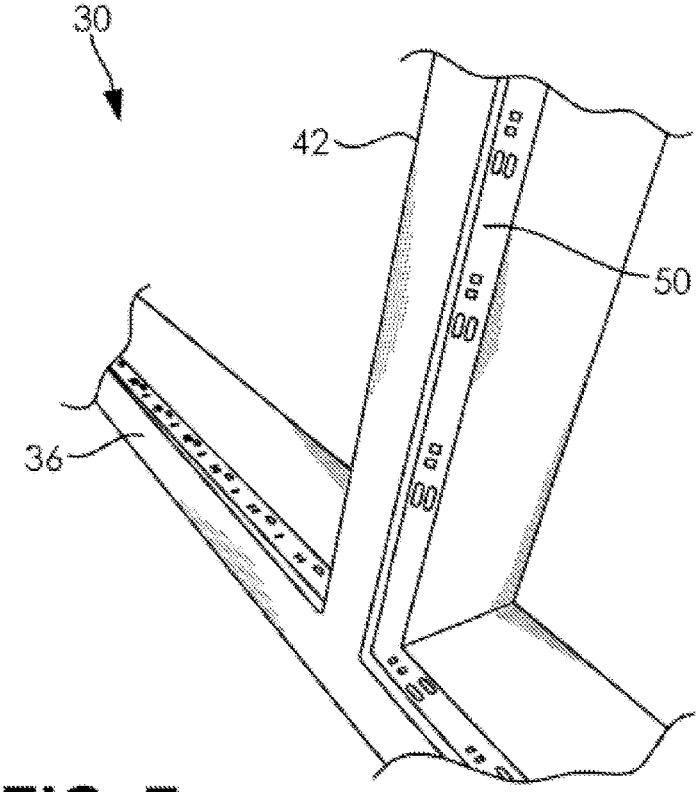
FIG. 7 is a perspective close up photograph of the center bracket connected to a side of the frame with the lighting strips attached in accordance with an embodiment of the invention.

FIG. 5 is a close up photograph showing a battery mounting bracket 48 affixed to upper portion 38 of the frame 34 and a battery pack 62 in the foreground with the right pivoting support leg 46 also visible. Electrical connecting wires 64 extend from the battery pack 62 for attachment to the lighting source 50. FIG. 6 is a close up photograph of the batter pack 62 mounted in the battery bracket 48. In a specific embodiment, the battery bracket 48 is made of twenty four gauge steel. FIG. 7 is a perspective close up photograph of the center bracket 42 connected to a side of the frame 36 with the lighting source 50 being lighting strips attached along the inner perimeter of the frame members. It is appreciated that a strip of individual light sources can be uniformly spaced along a frame or positioned to improve gaming surface lighting uniformity.

In some inventive embodiments, the battery pack 62 is charged by a solar panel or wind prop, shown generically at 71 in FIG. 6, so as to render the system operative in the field for a season or more without resort to new batteries being installed in the battery pack 62.

In some inventive embodiments, the light source 50 is adjusted to fill the playing surface with light from the light source that is uniform to within 800 illumination percent across the playing surface. In other inventive embodiments, the surface lighting is uniform from 100 to 400 illumination percent. It is appreciated that illumination can scale as an integer exponent of the current driving a light source, so illumination inhomogeneity of 800 percent across the distances of a gaming surface appear uniform to an unaided human eye. As a result, game play with an inventive gaming platform does not create the night vision blindness seen in gaming surfaces that lack the diffuse and uniform lights.

A process of game play conforms with a regulation court and has the target holes 20 set 33 feet (10 m) apart, or 27 feet (8.2 m) between the bottoms 40 of the platforms 30. Shorter distances may be used when younger players are participating or there is not sufficient room for a regulation court. A user extends at least one support leg 46 pivotally attached to a frame 34 of a pair of gaming platforms to set the playing surface at an angle to elevate the top edge 38 of the playing surfaces (32, 32') at twelve inches (300 mm) above the ground, and illuminating a light source 50 under low ambient light conditions, the light from the light source 50 filling the playing surface (32, 32'). Game play includes tossing a set of cornhole or bean bags assigned to a player or a team at a target hole 20 in the translucent panels 32' of an opponent's gaming platform, where one of the set of cornhole or bean bags tossed in the target hole 20 scores 3 points, while a cornhole or bean bag that lands and stays on the platform 30 scores 1 point; and where play continues until the team or player reaches the score of 21.

The foregoing description is illustrative of particular embodiments of the invention, but is not meant to be a limitation upon the practice thereof. The following claims, including all equivalents thereof, are intended to define the scope of the invention.

The invention claimed is:

1. A gaming platform comprising:

a frame;

a light source mounted to said frame arranged in strips along an inner perimeter of said frame and positioned to direct emitted light inward from said frame;

one or more translucent panels each having a light diffusing finish supported and surrounded by said frame, said one or more translucent panels forming a gaming surface with a target hole in one of said one or more translucent panels, the light diffusing finish of said one or more translucent panels acting to evenly fill the playing surface with light from said light source, the light entering an edge of the one or more translucent panels; and at least one support leg pivotally attached to said frame.

2. The gaming platform of claim 1 wherein said one or more translucent panels are formed from poly(methyl methacrylate).

3. The gaming platform of claim 1 further comprising an applied artwork on said one or more translucent panels.

4. The gaming platform of claim 3 wherein said applied artwork further comprises indicia of at least one of a logo for a sport team, school, company, or product advertising.

5. The gaming platform of claim 3 wherein said applied artwork is customizable by a user.

6. The gaming platform of claim 1 wherein said frame is made of wood, metal, or composite materials.

7. The gaming platform of claim 1 wherein said lighting source is a plurality of light emitting diodes (LEDs).

8. The gaming platform of claim 1 further comprising a mounting bracket for holding a battery pack, said battery pack in electrical communication with said lighting source.

9. The gaming platform of claim 1 wherein the fill of the playing surface with light from said light source is uniform to within 800 illumination percent across the playing surface.

10. The gaming platform of claim 1 further comprising a solar panel or a wind prop in electrical communication with a battery pack in electrical communication with said lighting source and adapted to charge said battery pack.

11. A process of game play comprising:

extending at least one support leg pivotally attached to a frame of a pair of gaming platforms, said gaming platforms each further comprising:

a light source mounted to said frame positioned to direct emitted light inward;

one or more translucent panels each having a light diffusing finish supported and surrounded by said frame, said one or more translucent panels forming a gaming surface with a target hole in one of said one or more translucent panels, the light diffusing finish of said one or more translucent panels acting to evenly fill the playing surface with light from said light source, the light entering an edge of the one or more translucent panels;

illuminating said light source under low ambient light conditions; and tossing a set of cornhole or bean bags at said target hole in one of said one or more translucent panels.

12. The process of claim 11 wherein said extending said at least one support leg sets the gaming surface at an angle with a top edge of the playing surface at twelve inches (300 mm) above the ground.

13. The process of claim 11 further comprising spacing the target holes in the pair of gaming platforms 33 feet apart, where shorter distances are user defined when younger players are participating or there is not sufficient room.

14. The process of claim 11 wherein the set of cornhole or bean bags are double-seamed fabric bags measuring 6 by 6 inches and weighing 15 to 16 ounces.

15. The process of claim 11 further comprising scoring the game play where one of the set of cornhole or bean bags tossed in the target hole scores 3 points, while a cornhole or bean bag that lands and stays on the platform scores 1 point; and wherein play continues until the team or player reaches a score of 21.

16. The process of claim 11 wherein said one or more translucent panels are formed from poly(methyl methacrylate) with an applied artwork on said one or more translucent panels.

17. The process of claim 11 further comprising powering said light source is powered with a battery pack, said battery pack being charged by a solar panel.

18. The process of claim 11 further comprising powering said light source is powered with a battery pack, said battery pack being charged by a wind prop.

* * * * *